US010220235B2

(12) United States Patent
Norris

(10) Patent No.: US 10,220,235 B2
(45) Date of Patent: Mar. 5, 2019

(54) CONTROLLED MOTION EXERCISE DEVICE

(71) Applicant: Joshua Norris, Springfield, IL (US)

(72) Inventor: Joshua Norris, Springfield, IL (US)

( * ) Notice: Subject to any disclaimer, the term of this patent is extended or adjusted under 35 U.S.C. 154(b) by 0 days.

(21) Appl. No.: 15/610,803

(22) Filed: Jun. 1, 2017

(65) Prior Publication Data

US 2018/0001128 A1 Jan. 4, 2018

Related U.S. Application Data

(63) Continuation-in-part of application No. 15/018,031, filed on Feb. 8, 2016, which is a continuation of application No. 13/898,718, filed on May 21, 2013.
(Continued)

(51) Int. Cl.
*A63B 21/00* (2006.01)
*A63B 24/00* (2006.01)
(Continued)

(52) U.S. Cl.
CPC ..... *A63B 21/018* (2013.01); *A63B 21/0058* (2013.01); *A63B 21/153* (2013.01);
(Continued)

(58) Field of Classification Search
CPC ..... A63B 21/00058; A63B 21/00069; A63B 21/00076; A63B 21/00181; A63B 21/005; A63B 21/0058; A63B 21/018; A63B 21/15; A63B 21/151; A63B 21/153; A63B 21/154; A63B 21/16; A63B 21/22; A63B 21/225; A63B 21/227; A63B 21/4023;
(Continued)

(56) References Cited

U.S. PATENT DOCUMENTS 3,372,928 A 3/1968 Showalter
3,387,493 A 6/1968 Strittmatter
(Continued)

FOREIGN PATENT DOCUMENTS

WO WO 88/07393 10/1988

OTHER PUBLICATIONS

Dong et al., "Rehabilitation device with variable resistance and intelligent control", Med Eng Phys. Apr. 2005; 27(3): 249-255.

*Primary Examiner* — Gary D Urbiel Goldner
(74) *Attorney, Agent, or Firm* — Woodard, Emhardt, Moriarty, McNett & Henry LLP

(57) ABSTRACT

An exercise apparatus includes a frame, one or more pull cables running through cable guides to provide resistance exercise, and a winding/coiling mechanism for providing variable resistance to the one or more pull cables. A resistance power shaft is engageable with a winding shaft and effective for turning the winding shaft upon rotation of the resistance power shaft. A coupling effective to temporarily disengage the winding/coiling mechanism from a resistance power mechanism, and thus to allow the one or more pull cables to be wound or unwound at a rate different from a rate at which a motor is running may also be included. A cable management spring to bias the one or more pull cables toward a wound condition may be used. A computer/processor may be used to control a resistance force applied to the one or more pull cables and/or to record exercise results.

11 Claims, 7 Drawing Sheets

Related U.S. Application Data

(60) Provisional application No. 61/649,616, filed on May 21, 2012.

(51) Int. Cl.

| | |
|---|---|
| ***A63B 69/00*** | (2006.01) |
| ***A63B 69/06*** | (2006.01) |
| ***A63B 21/005*** | (2006.01) |
| ***A63B 21/018*** | (2006.01) |
| ***A63B 23/035*** | (2006.01) |

(52) U.S. Cl.

CPC ..... *A63B 21/4035* (2015.10); *A63B 21/4043* (2015.10); *A63B 23/0355* (2013.01); *A63B 23/03541* (2013.01); *A63B 24/0087* (2013.01); *A63B 21/156* (2013.01); *A63B 23/03575* (2013.01); *A63B 69/06* (2013.01); *A63B 2069/0006* (2013.01)

(58) Field of Classification Search

CPC ..... A63B 21/4027; A63B 21/4033; A63B 21/4035; A63B 21/4043; A63B 21/4045; A63B 21/4049; A63B 23/035; A63B 23/03508; A63B 23/03516; A63B 23/03533; A63B 23/03541; A63B 23/0355; A63B 23/12; A63B 23/1209; A63B 23/1245; A63B 23/1281; A63B 24/0087; A63B 2024/0093; A63B 71/0054; A63B 2071/0072; A63B 2208/0204; A63B 2225/09; A63B 2225/093

See application file for complete search history.

(56) References Cited

U.S. PATENT DOCUMENTS

| | | | | |
|---|---|---|---|---|
| 3,785,644 | A | 1/1974 | Bradley et al. | |
| 4,082,267 | A | 4/1978 | Flavell | |
| 4,138,106 | A | 2/1979 | Bradley | |
| 4,184,678 | A | 1/1980 | Flavell et al. | |
| 4,479,647 | A | 10/1984 | Smith | |
| 4,540,171 | A | 9/1985 | Clark et al. | |
| 4,603,855 | A | 8/1986 | Sebelle | |
| 4,620,703 | A | 11/1986 | Greenhut | |
| 4,678,184 | A | 7/1987 | Neiger et al. | |
| 4,898,381 | A | 2/1990 | Gordon | |
| 4,949,959 | A | 8/1990 | Stevens | |
| 4,951,943 | A | 8/1990 | Farenholtz | |
| 4,979,733 | A | 12/1990 | Prud'hon | |
| 4,998,721 | A | 3/1991 | Anders et al. | |
| 5,048,826 | A | 9/1991 | Ryan | |
| 5,151,071 | A | 9/1992 | Jain et al. | |
| 5,304,104 | A | 4/1994 | Chi | |
| 5,328,429 | A | 7/1994 | Potash et al. | |
| 5,354,251 | A | 10/1994 | Sleamaker | |
| 5,360,382 | A | 11/1994 | Chi | |
| 5,409,435 | A | 4/1995 | Daniels | |
| 5,449,336 | A | 9/1995 | Sabel | |
| 5,588,938 | A | 12/1996 | Schneider et al. | |
| 5,643,157 | A | 7/1997 | Seliber | |
| 5,697,869 | A | 12/1997 | Ehrenfried et al. | |
| 5,738,611 | A | 4/1998 | Ehrenfried et al. | |
| 5,762,584 | A | 6/1998 | Daniels | |
| 5,993,356 | A | 11/1999 | Houston et al. | |
| 6,280,361 | B1 | 8/2001 | Harvey et al. | |
| 6,293,892 | B1 | 9/2001 | Slawinski et al. | |
| 6,422,981 | B1 | 7/2002 | Riser | |
| 6,569,065 | B1 | 5/2003 | Menold et al. | |
| 6,893,381 | B2 | 5/2005 | Slawinski | |
| 6,926,649 | B2 | 8/2005 | Slawinski | |
| 7,104,938 | B1 | 9/2006 | Smith | |
| 7,163,488 | B2 | 1/2007 | Anders et al. | |
| 7,278,958 | B2 | 10/2007 | Morgan | |
| 7,651,450 | B2 * | 1/2010 | Wehrell | A61H 1/0229 482/124 |
| 7,682,287 | B1 | 3/2010 | Hsieh | |
| 7,736,286 | B2 | 6/2010 | Panaiotov | |
| 7,819,785 | B2 | 10/2010 | Maiaro et al. | |
| 7,871,355 | B2 * | 1/2011 | Yeh | A63B 21/00196 482/1 |
| 7,918,769 | B2 | 4/2011 | LaMarque | |
| 7,963,886 | B1 * | 6/2011 | Schwinn | A63B 21/078 482/5 |
| 7,967,728 | B2 | 6/2011 | Zavadsky et al. | |
| 8,597,221 | B2 * | 12/2013 | Lisowski | A61H 1/0218 482/130 |
| 8,845,499 | B1 * | 9/2014 | Boatwright | A63B 21/015 482/116 |
| 8,876,672 | B2 * | 11/2014 | Schiano | A63B 21/078 482/104 |
| 8,900,097 | B1 | 12/2014 | Griggs et al. | |
| 2002/0086779 | A1 * | 7/2002 | Wilkinson | A63B 21/00069 482/118 |
| 2003/0171197 | A1 | 9/2003 | Levine et al. | |
| 2005/0233871 | A1 | 10/2005 | Anders et al. | |
| 2005/0250626 | A1 | 11/2005 | Charnitski | |
| 2006/0199706 | A1 | 9/2006 | Wehrell | |
| 2006/0199708 | A1 | 9/2006 | Alessandri et al. | |
| 2007/0021270 | A1 | 1/2007 | Nugent | |
| 2007/0054790 | A1 | 3/2007 | Dodge et al. | |
| 2007/0155587 | A1 | 7/2007 | Huang et al. | |
| 2008/0300116 | A1 * | 12/2008 | Eder | A63B 21/156 482/100 |
| 2009/0215591 | A1 * | 8/2009 | Alessandri | A63B 21/154 482/99 |
| 2009/0227433 | A1 * | 9/2009 | Humble | A63B 21/025 482/129 |
| 2009/0247376 | A1 * | 10/2009 | Merrithew | A63B 21/023 482/121 |
| 2011/0098155 | A1 | 4/2011 | Lemos | |
| 2011/0165995 | A1 | 7/2011 | Paulus et al. | |
| 2011/0172058 | A1 | 7/2011 | Deaconu et al. | |
| 2012/0053014 | A1 | 3/2012 | Zhu | |
| 2012/0058859 | A1 | 3/2012 | Elsom-Cook et al. | |
| 2012/0202656 | A1 * | 8/2012 | Dorsay | A63B 21/156 482/121 |
| 2012/0322635 | A1 | 12/2012 | Carter | |
| 2013/0090216 | A1 | 4/2013 | Jackson | |
| 2013/0130866 | A1 | 5/2013 | Wehrell | |
| 2013/0310230 | A1 * | 11/2013 | Norris | A63B 21/018 482/115 |
| 2014/0038777 | A1 * | 2/2014 | Bird | A63B 21/0058 482/5 |
| 2017/0021215 | A1 * | 1/2017 | Norris | A63B 21/018 |

* cited by examiner

CONTROLLED MOTION EXERCISE DEVICE

CROSS-REFERENCE TO RELATED APPLICATIONS

This application is a continuation-in-part of U.S. patent application Ser. No. 15/018,031, filed Feb. 8, 2016, which is a continuation of U.S. patent application Ser. No. 13/898,718, filed May 21, 2013, which claims the benefit of U.S. Provisional Patent Application No. 61/649,616, filed May 21, 2012. The entire contents of each related application is hereby incorporated herein by reference.

FIELD OF THE INVENTION

The present invention relates generally to exercise equipment, and more particularly to exercise equipment with controlled velocity or controlled range of motion.

BACKGROUND

Many exercises for therapy, sports, recreation or body-building involve the use of free weights. Free weights are held in the hand and moved along predetermined trajectories to exercise specific muscle groups. The motion is repeated for a specific number of times. However, it is difficult to precisely follow a predetermined trajectory for each repetition. It is also difficult to maintain a smooth and controlled motion. Abrupt loss of control may injure muscles. In certain strenuous exercises involving relatively heavy free weights, the repeated motion and weight can impact muscle groups other than those intended to be exercised, leading to injury and bruises. A heavy free weight held in the hand intended to exercise chest muscles may exert an unintentional heavy load on the knees. Free weights are also associated with dangers to other individuals exercising in the vicinity in case of loss of control. If a free weight falls from an individual's hand it may hurt other individuals.

Some exercise machines have been developed to overcome disadvantages associated with free weights and permit safe exercising. These exercise machines involve the use of adjustable weights loads enclosed in a frame, which are connected through pulleys, gears and cables to frames and handles. The user exerts force on the handles and frames, and the cables transmit the load of the weight to the user. This may reduce some of the dangers associated with free weights.

However, these exercise machines are expensive. Many of them are directed to exercising specific muscle groups. Further, these machines often have a limited adjustability and the configuration of use is largely fixed. It is difficult to use the same machine in different configurations. A machine devised for a healthy individual exercising in a gym may not be suitable for a hospitalized individual who is unable to move from his or her bed. A machine devised for exercising the thighs may not be useful for exercising the forearms.

The motion of free weights or the weights in exercise machines move according to the laws of gravity. When these weights are moved along a trajectory, they always exert a force component in a downwards direction. When a free weight is lifted, the part of the trajectory in which the weight is moved against the ground is controlled by the individual. However, in the final part of the trajectory, the weight moves towards the ground. In this part of the trajectory, the force exerted at every point of the trajectory against the user's muscles is uniform and dictated by the weight. In case of the exercise machines the force exerted is always uniform and depends on the selected weight or load.

This makes maintaining a uniform velocity throughout the trajectory very difficult for individuals. An individual may be able to move the weight with a controlled velocity for a part of the trajectory but may lose control, leading to a rapid velocity change. Such unintended velocity changes along the trajectory of motion of free weights or weights in exercising machines can cause short-term or long-term injuries to the user.

Certain exercises need the velocity of motion along the trajectory and exerted force to vary in a predetermined manner along the trajectory path of motion of the exercise equipment.

A need exists for a low-cost and flexible exercise machine that allows controlled motion exercise of various different muscle groups. A need also exists for an exercise machine that ensures the safety of the exercising individual and the safety of other individuals in the vicinity of the exercising individual. A need also exists for a machine that can be used by users who may not have full control over their bodies. A need also exists for an exercise machine that can be used by users in various positions such as standing, sitting or lying horizontally. A need also exists for a machine that exerts force varying along the trajectory of motion of exercise in a predetermined manner. A need also exists for a machine that allows exercising parts to move along a specified trajectory with a velocity that varies along the trajectory of motion in a predetermined manner. Various aspects and embodiments of the present invention are intended to address one or more of these needs.

SUMMARY

In one aspect of the present invention there is provided an exercise apparatus comprising:

a) a frame, comprising:

i) a pair of upright support members, and ii) at least one cross member spanning between said pair of upright support members;

b) one or more guides selectively positionable at a multiplicity of mounting positions on one or more of said upright support members and/or on one or more of said cross members, said guides being effective for establishing a pull point for a cable passing therethrough;

c) one or more cables having a pull end and a winding end, and a length passing through one or more of said guides;

d) a winding/coiling mechanism comprising:

i) a winding/coiling shaft, ii) a spool mounted on said winding/coiling shaft and effective for controllably winding one or more of said cables around said shaft upon rotation of the shaft, iii) a winding/coiling shaft gear mounted on said winding/coiling shaft and effective for rotating said winding/coiling shaft upon rotation of said winding/coiling shaft gear; and e) a resistance power mechanism comprising:

i) a resistance power shaft, ii) a motor for rotating said resistance power shaft at a variable speed and/or with a variable force in a direction effective for winding one or more of said cables around said winding/coiling shaft, iii) a resistance power shaft gear mounted on said power shaft and engageable with said winding shaft gear and effective for turning said winding shaft gear upon rotation of said power shaft gear;

f) a coupling effective to temporarily disengage the winding/coiling mechanism from the resistance power mechanism, and thus to allow the cable to be wound or unwound at a rate different from the rate at which the motor is running; and g) a cable management spring effective to bias the cable toward its wound condition.

The apparatus may utilize upright members that are spaced between 48" and 96" apart, and at least one cross member that is mounted to the upright members at a height of between 60" and 120".

The apparatus may utilize a motor that is effective for providing a variable resistance force that includes at least some of the range between 5 lbf and 500 lbf of resistance force.

The apparatus may utilize guides that comprise an eye or a pulley and a shank mountable to one or more of a multiplicity of mounting positions, which individually may comprise slots for receiving the shank of said guides.

DESCRIPTION OF PREFERRED EMBODIMENTS

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
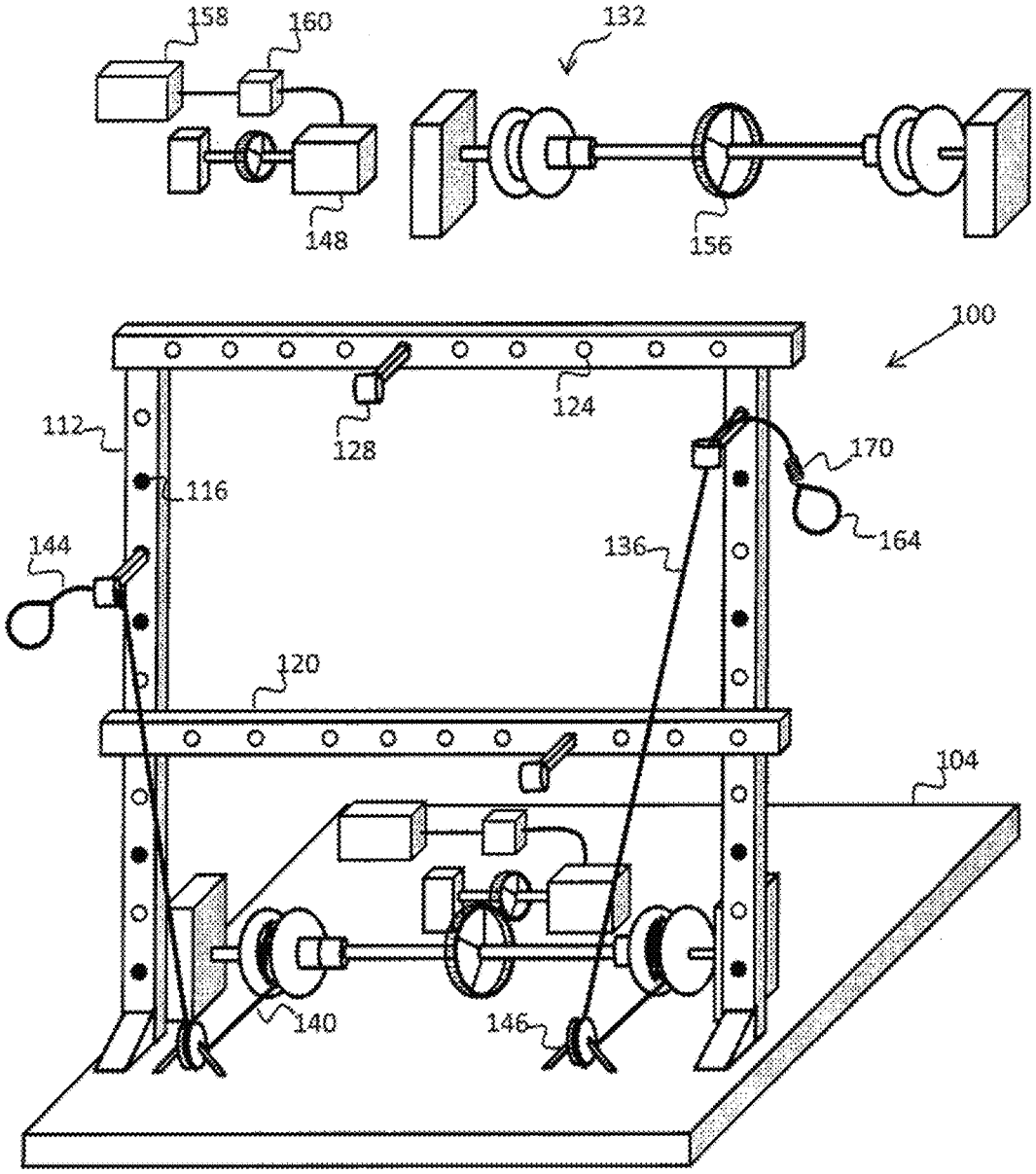
FIG. 1 shows a perspective view of one embodiment of the present invention.

FIG. 1 shows a controlled motion exercise machine 100 according to an embodiment. The controlled motion exercise machine 100 contains a base 104. The base 104 supports the machine. In various embodiments, the base 104 is made of a metal, wood or other materials that safely support the weight of the machine and the user. In various embodiments, the base 104 has a protective layer of plastic or rubber or other materials. The protective layer may help users of the machine get a grip on the surface while standing or sitting on the base 104.

The controlled motion exercise machine 100 illustrated in FIG. 1 contains a rigid frame 112. In various embodiments, the rigid frame 112 is made of metal, plastic, carbon-fiber composite or any material strong enough to withstand the overall load exerted on the rigid frame 112. The rigid frame 112 contains adjustment slots adjustment slots 116. An adjustable beam adjustable beam 120 is secured to the adjustment slots 116. In an embodiment, the adjustable beam 120 is in a horizontal configuration. In another embodiment, the adjustable beam 120 is in a vertical configuration. In yet another embodiment, the adjustable beam 120 is in a diagonal configuration. In other embodiments, the adjustable beam 120 is in any suitable configuration.

In various embodiments, removable fasteners firmly secure the adjustable beam 120 in the predetermined configuration for the duration of the exercise to the rigid frame 112. The adjustable beam 120 remains in a fixed configuration once secured to the adjustment slots 116. The configuration and position of the adjustable beam 120 can be readjusted for different exercises by disengaging the removable fasteners securing the adjustable beam 120 to the adjustment slots 116, rearranging the position or the configuration of the adjustable beam 120, and then reengaging the fasteners to secure the adjustable beam 120 to the rigid frame 112 in a fixed configuration.

One or more guides are selectively positioned at a multiplicity of mounting positions on one or more of said upright support members and/or on one or more of said cross members, with the guides being effective for establishing a pull point for a cable passing therethrough. The guides may be in the form of hoop slots 124 provided at various locations on the rigid frame 112 and the adjustable beam 120. In an embodiment, hoop slots 124 completely pass through the material of the adjustable beam 120 and/or the rigid frame 112. In another embodiment, hoop slots 124 partially pass through the material of the adjustable beam 120 and/or the rigid frame 112. In an embodiment, a predetermined number of hoops 128 are secured to predetermined hoop slots 124 on the adjustable beam 120 and/or on the rigid frame 112. In another embodiment, hoops 128 are secured to the hoop slots 124 by easily removable fastening mechanisms. In an embodiment, hoop slots 124 have recessed threads and hoops 128 have protruding threads such that hoops 124 can be screwed on to hoop slots 124. In another embodiment, hoops 124 have eyelets at their ends and they are secured with latches after passing through the hoop slots 124. In another embodiment, hoop slots 128 are secured to hoop slots 124 by nut-and-bolts or any other fasteners.

A coiling mechanism 132 may be secured to the base 104. The coiling mechanism 132 allows a cable 136 to be wound on it. In an embodiment, the coiling mechanism 132 contains a spring or similar elastic element that retracts the cable 136 when not in use.

Cable 136 has two ends, a winding end 140 and an operating end 144. The winding end 140 of the cable 136 is wound on the coiling mechanism 132.

To prepare the controlled motion exercise machine 100 for a particular exercise, the user or trainer passes the cable 136 through a guide pulley 146 and one or more hoops 128 such that the operating end 144 of the cable 136 is free to be engaged by the user when the exercise begins.

In the embodiment if FIG. 1, a robotic motor 148 is secured to the base 104. In another embodiment, the robotic motor 148 is contained in a motor housing secured to the base 104. In an embodiment, the robotic motor 148 is coupled to the coiling mechanism 132 through a gear system 156. The robotic motor 148 turns the coiling mechanism 132 such that the cable 136 is wound or unwound according to the exercise on the coiling mechanism 132. In an embodiment, the robotic motor 148 is controlled by electronic impulses sent by a computer controller 158. The computer controller 158 may be a laptop, a desktop computer or a portable computer or any other computing device. In another embodiment, the computer controller 158 is connected to the robotic motor 148 through a power amplifier 160 in a feedback loop. The power amplifier 160 amplifies the electronic impulses sent by the computer controller 158. In an embodiment, the feedback loop allows the computer controller 158 to sense the operation of the robotic motor 148 in response to electronic impulses and force exerted on the cable 136 by the user. In another embodiment, the feedback loop also allows the computer controller 158 to receive information about the load or force exerted on the robotic motor 148 through the gear system 156 by the cable 136.

The user exerts a force or load on the cable 136 against the force exerted by the robotic motor 148 to exercise target muscles. A user selects an exercise through the computer controller 158. The computer controller 158 selects a program of electronic impulses and sends these electronic impulses determined by the exercise selected by the user to the robotic motor 148 through the power amplifier 160. The robotic motor 148 begins to wind or unwind the coiling mechanism 132 as directed by the electronic impulses. The coiling mechanism 132 either retracts the cable 136 at a predetermined velocity or allows the cable 136 to be extended at a predetermined velocity depending on the exercise chosen by the user using the computer controller 158.

The user exerts load or force on the operating end 144 of the cable 136 against the force applied by the robotic motor 148. The robotic motor 148 senses the force exerted by the user on the cable 136 and operates such that the cable 136 moves at a predetermined velocity regardless of the force exerted by the user, resulting in a controlled motion exercise.

In one embodiment, the computer controller 158 continuously monitors the force exerted on the robotic motor 148 by the user. The computer controller 158 directs the motion of the cable 136 by sending electronic impulses to the robotic motor 148 in response to the force exerted by the user so that the cable 136 moves in accordance with the exercise chosen by the user.

The hoops 128 guide the motion of the cable 136 along a path appropriate for the exercise chosen by the user so that the motion of the cable results in the application of force in a predetermined direction such that specific muscle groups are exercised without harming the other muscles of the user.

In one embodiment, an ergonomic grasp 164 is connected to the operating end 144 of the cable 136. In various embodiments, the ergonomic grasp 164 is in the form of a rod, a handle, a ball, or any other form that is useful for particular exercises. In an embodiment, the ergonomic grasp 164 is shaped like a ball for exercising baseball pitching movements. In another embodiment, the ergonomic grasp 164 is shaped like a staff for facilitating rowing exercises.

In one embodiment the robotic motor 148 is connected to two cables 136, and with the ergonomic grasp 164 in the form of a rigid staff secured to both cables 136, such that pulling on the staff engages both cables 136 simultaneously. In yet another embodiment, the operating ends 144 of two cables 136 can be connected by an ergonomic grasp 164 in the form of a long rod or a staff, for martial arts or other exercises. In various embodiments, the ergonomic grasp 164 is made of materials such as metal, rubber, plastic, wood or any other material suitable for a particular form of exercise. In an embodiment, the ergonomic grasp 164 has a shape suitable for physical therapy. In another embodiment, the ergonomic grasp 164 is shaped such that a trainer can assist the exercising user in exerting force.

In one embodiment, the ergonomic grasp 164 is connected to the operating end 144 of the cable 136 by a flexible connector 170. In various embodiments, the flexible connector 170 contains springs, rubber cables, elastic bands, rubber bands, or other flexible elements. The flexible connector 170 allows the user to get non-linear play in the motion superimposed on the predetermined velocity of the cable 136 controlled by the robotic motor 148. This allows the user to exert slightly higher or lower forces on the cable without facing sudden velocity changes that can result in injury.

The Examples given above are merely illustrative and are not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention which are obvious to those skilled in the chemical arts or in the relevant fields are intended to be within the scope of the appended claims.

In another preferred embodiment of the present invention there is provided a controlled motion exercise device that includes a frame, one or more cables for the user to pull to provide resistance exercise, and a mechanism for providing variable resistance to the cables.

The frame may comprise a pair of uprights and one or more cross members, optionally mounted to a base. The uprights are preferably spaced between 36" and 96" apart to allow a user to mount cable guides on both sides of the user's body when the user is positioned near the center of the frame. More preferably the uprights are spaced between 36" and 72" apart.

At least one of the cross members is preferably positioned at a height of between 60" and 120" to allow a user to mount cable guides well above the user's head when the user is positioned near the center of the frame. In one preferred embodiment there are two cross members mounted at varying heights to the pair of uprights. In such embodiments, the second cross member is preferably positioned at a height of between 12" and 60", and more preferably at a height of between 24" and 48." The cross members are preferably horizontal with respect to the base.

A plurality of positions for mounting a cable guide to the frame are provided on each of the pair of uprights, and on one or more of the cross members. Such positions for mounting a cable guide preferably comprise slots that are sized to receive the shank of a cable guide as described below. The slots provide discrete locations for mounting a cable guide shank, with such locations preferably being between 6" and 12" apart (preferably about 8" apart) along at least a portion of each upright and along at least one cross member.

A plurality of cable guides are preferably mounted to the uprights and/or the cross members. The cable guides are adapted to allow a pull cable to pass therethrough, thus providing one or more "pull points" from which the resistance on the pull end of a cable may be applied. The guides may be mounted to any of a plurality of points on the uprights and/or the cross members to allow the user to select an advantageous pull point for a desired exercise. When multiple guides are provided on the frame, and particularly when those guides are mounted to different uprights and/or different cross members, the user may independently pull two or more arms and/or legs simultaneously, with the two or more arms and/or legs meeting resistance from different pull points which may be on different sides of the user's body.

The cable guides may comprise an eye or a hoop that is provided on the end of a shank. In one embodiment the cable guides comprise a pulley on the end of a shank. The pulley allows the cable to pass through the guide with less resistance than is provided by a hoop or an eye.

The cable guides are mountable to one or more of a multiplicity of mounting positions on the frame by providing the frame with a plurality of slots adapted to receive the guide shanks. This allows the user to quickly and easily change the pull point of a particular cable, and also allows such change to be done without also changing the position of the uprights and/or the cross members, and without changing the locations of the pull point of other cables that may be being used at the same time. The user simply pulls the cable guide shank from one slot and pushes it into a different slot without requiring the cable or the frame to be adjusted.

Each cable comprises a pull end and a winding/coiling end, and a length that may pass through a guide. The guides accordingly provide "pull points" from which the resistance on the pull end of a cable is applied.

The winding end of each cable is wound around a coiling mechanism that may comprise one or two or more winding/coiling spools or reels on a shaft. A coiling gear is also provided on the shaft. The ends of the shaft are stabilized so that the shaft may rotate to allow the cable to wind or unwind around the spool/reel.

The winding/coiling mechanism is connected through a pair of gears to a resistance power mechanism. The resistance power mechanism comprises a resistance power shaft and a motor. The motor may be a robotic or servo motor that provides variable and selectable resistance power to resist a pulling force applied by a user to the pull end of a cable. The gears allow a small resistance force to be generated by the motor and a greater resistance force to be applied to the user.

A computer/processor may be used to control the resistance force applied to the cables and/or to record exercise results.

Figure 2:
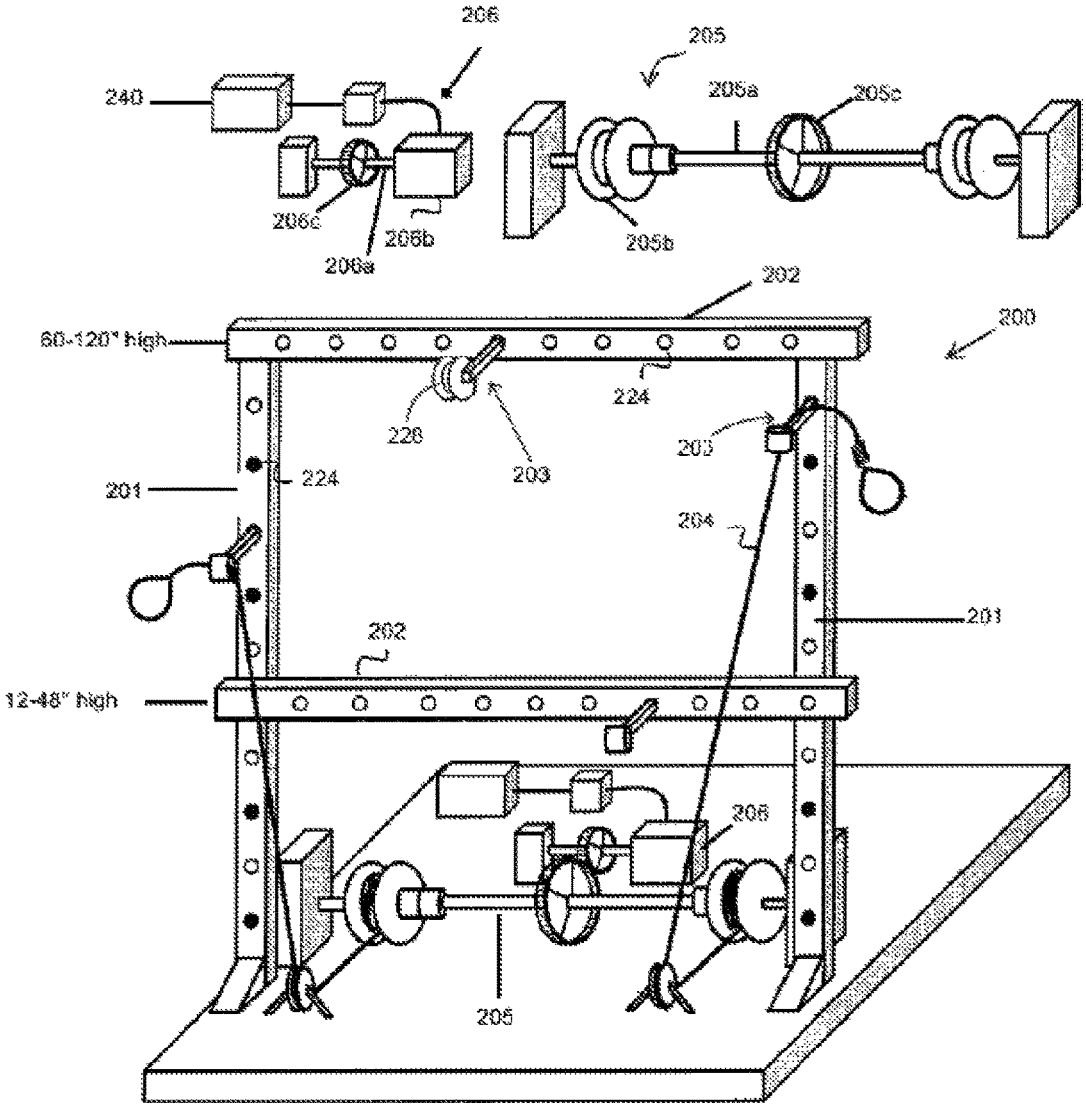
FIG. 2 shows a perspective view of one embodiment of the present invention.
Figure 3:
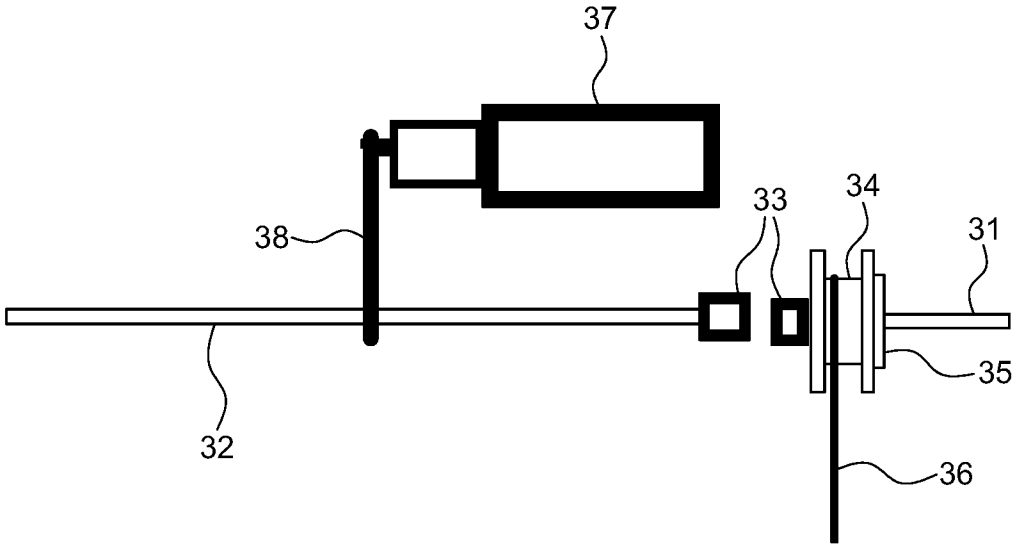
FIG. 3 shows certain aspects of the coupling and winding mechanisms of one embodiment of the present invention.
Figure 4:
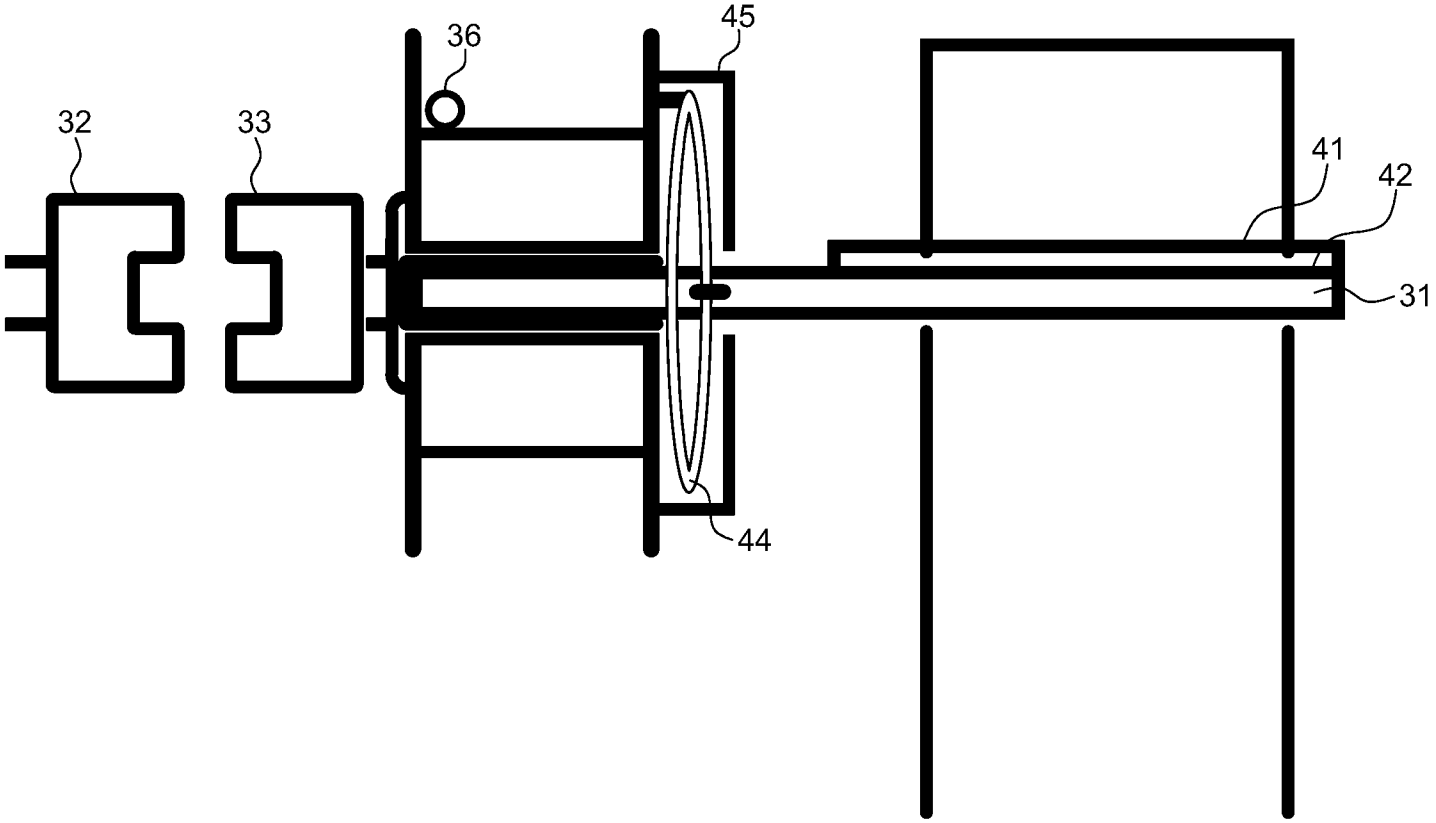
FIG. 4 shows other details of the coupling and winding mechanisms of one embodiment of the present invention.

Referring now to FIG. 2 of the drawings, the illustrated device is an exercise apparatus comprising:

a) a frame (200), comprising:
   i) a pair of upright support members (201), and
   ii) at least one cross member (202) spanning between said pair of upright support members;
b) one or more guides (203) selectively positionable at a multiplicity of mounting positions, such as slots (224), on one or more of said upright support members and/or on one or more of said cross members, said guides being effective for establishing a pull point for a cable passing therethrough;
c) one or more cables (204) having a pull end and a winding end, and a length passing through one or more of said guides;
d) a winding/coiling mechanism (205) comprising:
   i) a winding/coiling shaft (205*a*),
   ii) a spool (205*b*) mounted on said winding/coiling shaft and effective for controllably winding one or more of said cables around said shaft upon rotation of the shaft,
   iii) a winding/coiling shaft gear (205*c*) mounted on said winding/coiling shaft and effective for rotating said winding/coiling shaft upon rotation of said winding/coiling shaft gear; and
e) a resistance power mechanism (206) comprising:
   i) a resistance power shaft (206*a*),
   ii) a motor (206*b*) for rotating said resistance power shaft at a variable speed and/or with a variable force in a direction effective for winding one or more of said cables around said winding/coiling shaft,
   iii) a resistance power shaft gear (206*c*) mounted on said power shaft and engageable with said winding shaft gear and effective for turning said winding shaft gear upon rotation of said power shaft gear.

A computer/processor 240 effective for controlling the resistance force applied to the cables and effective for recording exercise results is also included.

The illustrated apparatus utilizes upright members that are spaced between 36" and 96" apart.

The illustrated apparatus utilizes at least one cross member that is mounted to said upright members at a height of between 60" and 120".

The illustrated apparatus may utilize a motor that is effective for providing a user-selected variable resistance force that includes all or at least some of the range between 5 lbf and 1000 lbf of resistance force. In addition to being adjustable as to force, the motor may also be adjustable as to speed, which preferably may wind the cables at a user-selected speed of up to about 3 ft/sec, and more preferably up to about 1 ft/sec.

The illustrated apparatus may utilize guides that comprise an eye and a shank mountable to one or more of said multiplicity of mounting positions. Additionally or alternatively, one or more of the guides may comprise a pulley 228 mounted on a shank that is mountable to said uprights and/or to said cross members at one or more of said multiplicity of mounting positions.

The illustrated apparatus may utilize a multiplicity of mounting positions which individually comprise slots for receiving the shank of said guides.

Referring now to FIGS. 3-7, in one embodiment of the present invention the winding shaft slides back and forth to engage and disengage from the power shaft. This eases operations as readjusting is done without having to use or fight against the motor. Instead, it just pulls freely in and out. This also allows a user to do "mock" motions of the exercise to be sure that it's the motion you want to do before engaging the motor.

A coupling mechanism is preferably used to control the engagement of the power shaft to the cable winding mechanism. The coupling mechanism is preferably effective to temporarily disengage the winding/coiling mechanism from the resistance power mechanism, and thus to allow the cable to be wound or unwound at a rate different from the rate at which the motor is running. In the most preferred embodiments the device uses a cable management spring to bias the cable toward its wound condition when the power mechanism is disengaged from the winding/coiling mechanism.

In the illustrated embodiment the winding drum rotates on the winding shaft. The winding mechanism, which may be a spring, winds with the rotation of the winding drum around the winding shaft. As the cable is pulled out, the spring winds and gives energy to spin the winding drum and the cable to its original position when released. This enables easy positioning and trial or mock motions of the exercise without having to use motor controls. With the desired exercise setup and understood by user; the winding shaft slides horizontally to engage the coupling on the winding drum to the coupling on the power shaft. After this, the power shaft rotates the winding drum. This action still spins the winding spring around the non-spinning winding shaft. There is no danger of over spinning the spring as the cable will end before this.

When engaged with the power shaft, the coupling turns the cable drum which is connected to a cable management spring. The drum shaft does not turn so the cable management spring begins to wind. The length of the cable and the spring winding are made in a manner such that one will run out of cable before overwinding the cable management spring.

Accordingly, in the illustrated embodiment the spring mechanism is devised in such a way that the cable drum spins but the shaft the drum is on does not. This allows the spring to wind and unwind. When disengaged from the power shaft, the cable pull by the user winds and unwinds the cable management spring and drum shaft mechanism.

A keystock and keys may be used to prevent the drum shaft from rotating. The drum shaft slides horizontally along the keystock/keys but never outside of the keys. This horizontal slide of the drum shaft also slides the cable drum and coupling in and out of connection with the power shaft.

This quick and ease of use of the cable management spring is important in relationship to the design of the frame. The frame is versatile in its design and being capable of adjusted in so many ways with so many different lengths of cable needed for each, that quick readjustment afforded by the cable management spring is an important feature.

Figure 5:
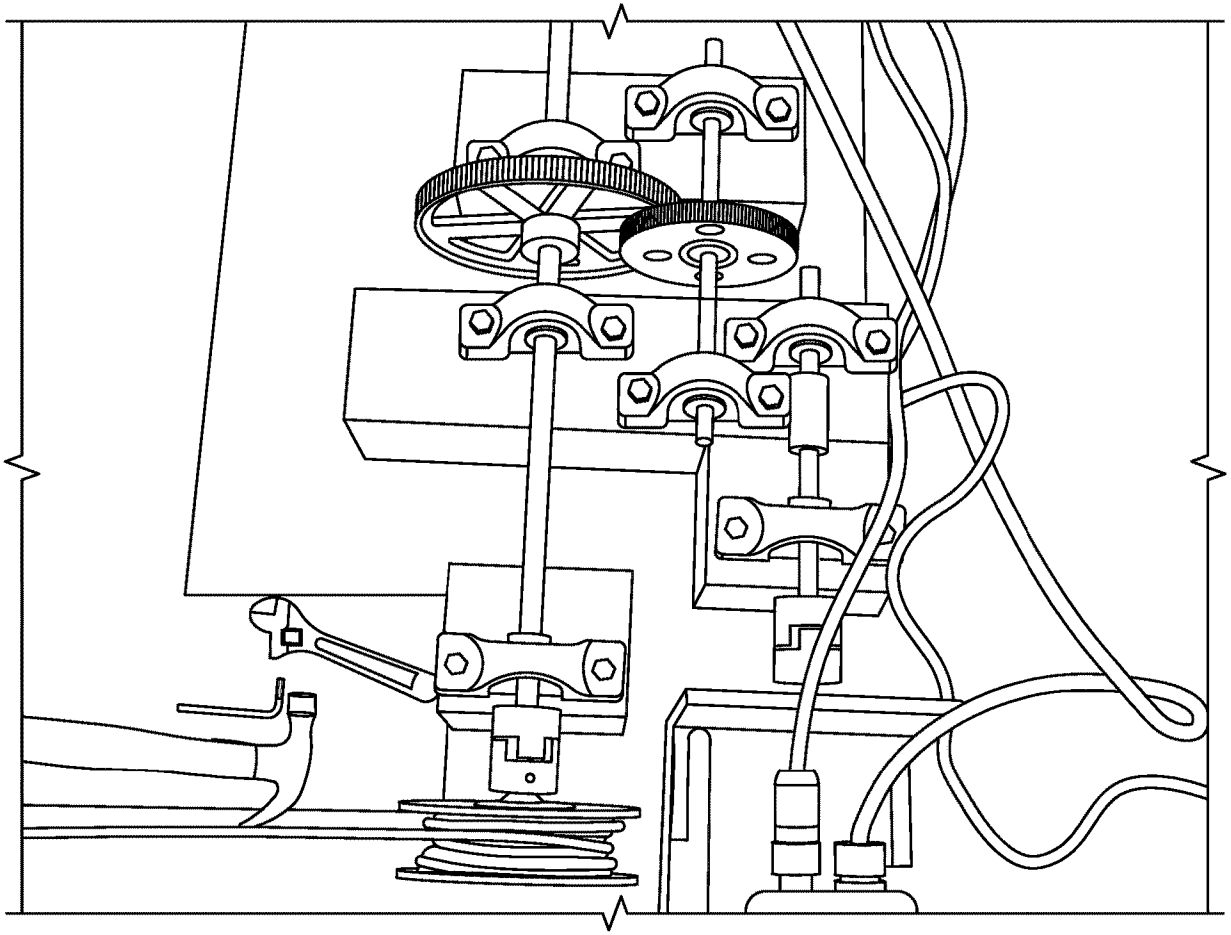
FIG. 5 shows other details of the coupling and winding mechanisms of one embodiment of the present invention.
Figure 6:
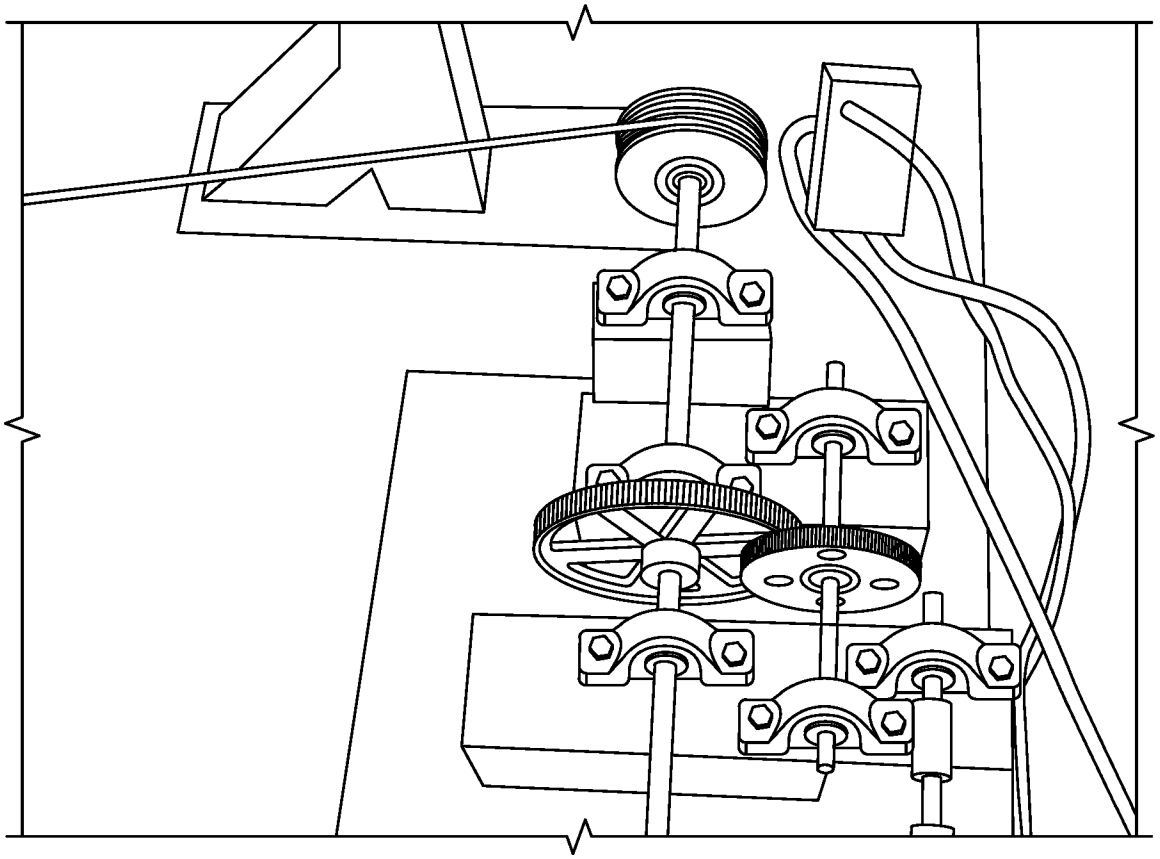
FIG. 6 shows other details of the coupling and winding mechanisms of one embodiment of the present invention.
Figure 7:
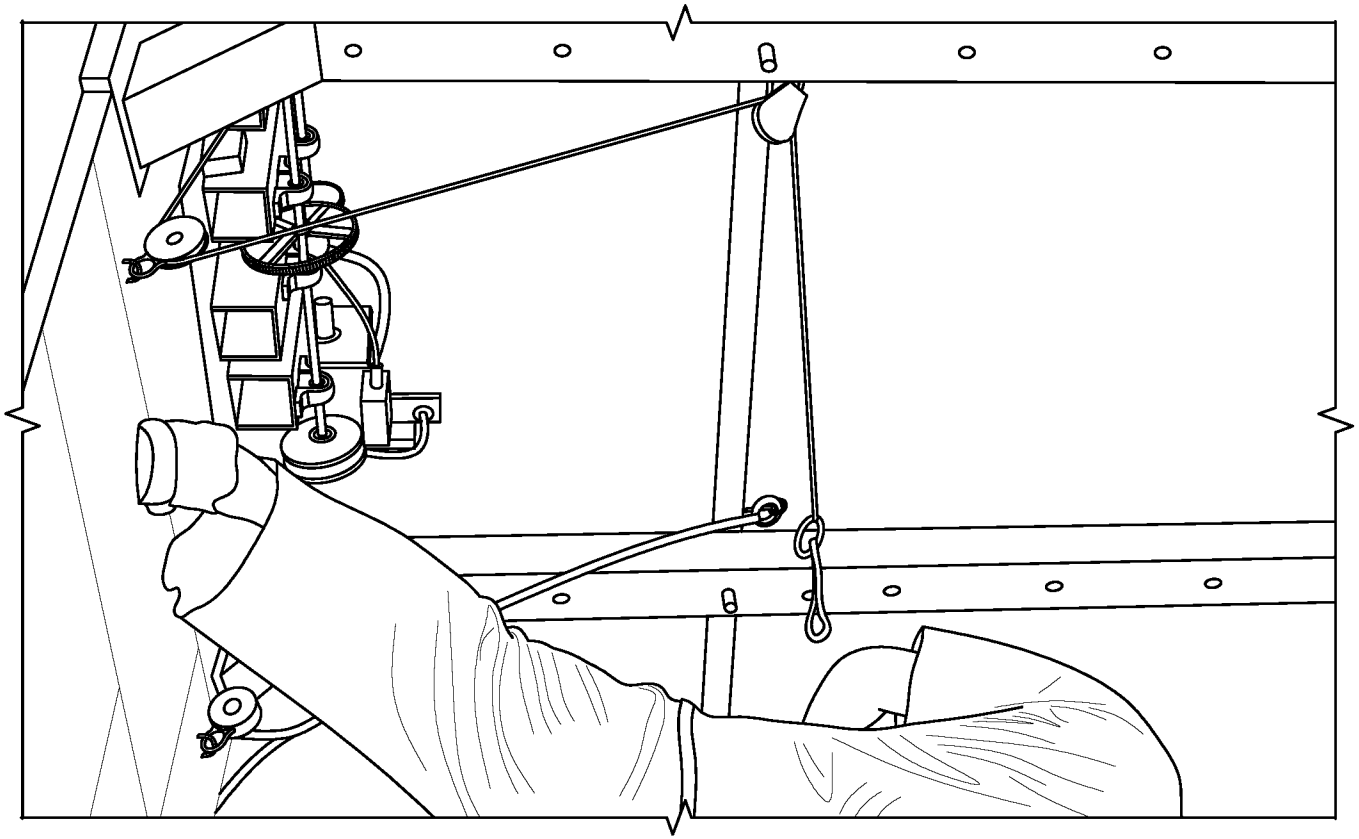
FIG. 7 shows other details of the coupling and winding mechanisms of one embodiment of the present invention.

Referring more particularly to FIGS. 5-7, one embodiment of the preferred cable spool and clutches is shown. Coming out of the motor, the gears connect. On the last largest gear is the longest drive shaft. The shaft goes through bearings that are mounted/bolted to the frame. There are preferably four of these along the largest shaft, two on each side. On one side, just outside the second bearing, is a coupling. One side is on the end of the shaft, and the other side is attached to the cable spool. When the coupling is pushed together, the drive shaft turns cable spool. On the opposite side of the cable spool from the coupling, a shaft extends from the cable spool that enters into a frame housing. This shaft does not spin at all but only slides horizontally along inside the housing to disengage the coupling from the drive shaft. When it disengages from the drive shaft, the coiling and recoiling of the cable spool is controlled by a spring (or optionally a second mechanism from the drive shaft). It looks like a large hockey puck, attached to the cable spool on the opposite side from the coupling. It is around the shaft that does not rotate and the spring inside is attached to the shaft. The non-spinning shaft, but the spinning cable spool is responsible for the winding of the spring, that powers this second winding mechanism, that is independent of the drive shaft, so that one side or both sides can be used and the length/position of the cable used can be easily adjusted manually without having to turn on the main drive shaft.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, it is to be appreciated that the present invention may comprise or consist essentially of any or all of the illustrated or described elements and/or features. For example, the present invention includes devices comprising each of the elements and/or features illustrated in FIGS. 1 and 2, and the present invention includes devices consisting essentially of any of the elements and/or features illustrated in FIGS. 1 and 2. Additionally, all of the features and/or embodiments disclosed in Applicant's U.S. Patent Application No. 61/649,616, which is incorporated herein by reference, may be combined with any or all of the features disclosed herein to provide a device that comprises or consists essentially of such features.

The invention claimed is:

1. An exercise apparatus comprising:

a) a frame, comprising:
  i) a pair of upright support members, and
  ii) at least one cross member spanning between said pair of upright support members;

b) one or more guides selectively positioned at a multiplicity of mounting positions on one or more of said pair of upright support members and on at least one of said at least one cross member, said one or more guides being effective for establishing a multiplicity of selected pull points for one of one or more cables passing respectively therethrough;

c) said one or more cables, each having a pull end and a winding end, and a length passing respectively through said one or more guides;

d) a winding/coiling mechanism comprising:
  i) a winding/coiling shaft,
  ii) a spool mounted on said winding/coiling shaft and effective for controllably winding one or more of said one or more cables around said winding/coiling shaft upon rotation of the winding/coiling shaft,
  iii) a winding/coiling shaft gear mounted on said winding/coiling shaft and effective for rotating said winding/coiling shaft upon rotation of said winding/coiling shaft gear;

e) a resistance power mechanism comprising:
  i) a resistance power shaft,
  ii) a motor for rotating said resistance power shaft at a variable speed and with a variable force in a direction effective for winding one or more of said one or more cables around said winding/coiling shaft,
  iii) a resistance power shaft gear mounted on said resistance power shaft and engageable with said winding/coiling shaft gear and effective for turning said winding/coiling shaft gear upon rotation of said resistance power shaft gear;

f) a coupling effective to temporarily disengage the winding/coiling mechanism from the resistance power mechanism, and thus to allow one or more of said one or more cables to be unwound at a rate different from a rate at which the motor is running; and g) a cable management spring to bias one or more of said one or more cables toward a wound condition.

2. The apparatus of claim 1 wherein said pair of upright members are spaced between 36 inches and 96 inches apart.

3. The apparatus of claim 1 wherein at least one of said at least one cross member is mounted to said pair of upright support members at a height of between 60 inches and 120 inches.

4. The apparatus of claim 1 wherein said at least one cross member comprises two cross members.

5. The apparatus of claim 1 wherein said motor is effective for providing the variable force that includes all or at least some of a range between 5 foot pounds and 1000 foot pounds of resistance force.

6. The apparatus of claim 1 wherein said motor is effective for winding one or more of said one or more cables at the variable speed of between 0 ft/second and 3 ft/second.

7. The apparatus of claim 1 wherein one or more of said one or more guides comprise a pulley mounted on a shank that is mountable to one or more of said pair of upright support members, and to one or more of said at least one cross member at one or more of said multiplicity of mounting positions.

8. The apparatus of claim 7 wherein said multiplicity of mounting positions comprise slots for receiving the shank of one or more of said one or more guides.

9. The apparatus of claim 1 and further including a computer/processor effective for controlling the variable resistance force applied to said one or more cables.

10. The apparatus of claim 1 and further including a computer/processor effective for recording exercise results.

11. An exercise apparatus comprising:

a) a frame, comprising:

i) a pair of upright support members spaced apart at a distance of between 36 inches and 96 inches, and ii) a pair of cross members spanning between said pair of upright support members, with one of said pair of cross members being mounted at a height of between 24 inches and 60 inches, and the other of said pair of cross members being mounted at a height of between 60 inches and 120 inches;

wherein said pair of upright support members and said pair of cross members combine to form a rectangular construct that is configured to allow one or more cable guides to be positioned around the rectangular construct at one or more of a selected multiplicity of mounting positions above and to both sides of a user standing between the pair of upright support members;

b) said one or more cable guides selectively positioned at one or more of the selected multiplicity of mounting positions on one or more of said pair of upright support members and on one or more of said pair of cross members, said one or more cable guides being effective for establishing a multiplicity of selected pull points for one of one or more cables passing respectively therethrough;

said one or more cable guides being movable from one pull point to another pull point without moving either of said pair of upright support members or either of said pair of cross members;

c) said one or more cables, each having a pull end and a winding end, and a length passing respectively through said one or more guides;

d) a winding/coiling mechanism comprising:

i) a winding/coiling shaft, ii) a spool mounted on said winding/coiling shaft and effective for controllably winding one or more of said one or more cables around said winding/coiling shaft upon rotation of the winding/coiling shaft, iii) a winding/coiling shaft gear mounted on said winding/coiling shaft and effective for rotating said winding/coiling shaft upon rotation of said winding/coiling shaft gear;

e) a resistance power mechanism comprising:

i) a resistance power shaft, ii) a motor for rotating said resistance power shaft at a variable speed and with a variable force in a direction effective for winding one or more of said one or more cables around said winding/coiling shaft, iii) a resistance power shaft gear mounted on said resistance power shaft and engageable with said winding/coiling shaft gear and effective for turning said winding/coiling shaft gear upon rotation of said resistance power shaft gear;

f) a coupling effective to temporarily disengage the winding/coiling mechanism from the resistance power mechanism, and thus to allow one or more of said one or more cables to be unwound at a rate different from a rate at which the motor is running; and g) a cable management spring to bias one or more of said cables toward a wound condition.

* * * * *